US007083002B2

(12) United States Patent
Matsumoto et al.

(10) Patent No.: US 7,083,002 B2
(45) **Date of Patent: *Aug. 1, 2006**

(54) BLADE MOUNTING STRUCTURE OF BULLDOZER

(75) Inventors: Norihisa Matsumoto, Hirakata (JP); Tatsuo Wada, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/909,230

(22) Filed: Jul. 30, 2004

(65) Prior Publication Data

US 2005/0034880 A1 Feb. 17, 2005

Related U.S. Application Data

(63) Continuation-in-part of application No. 10/719,325, filed on Nov. 20, 2003, now Pat. No. 7,013,983.

(30) Foreign Application Priority Data

Jun. 18, 2003 (JP) ..... 2003-173272

(51) Int. Cl.
*E02F 3/76* (2006.01)

(52) U.S. Cl. ..... 172/822; 172/823; 172/824

(58) Field of Classification Search ..... 172/810, 172/811, 818, 819, 820, 821, 822, 823, 824, 172/826, 828

See application file for complete search history.

(56) References Cited

U.S. PATENT DOCUMENTS

| | | | |
|---|---|---|---|
| 3,395,764 | A | 8/1968 | Wirt |
| 3,441,092 | A | 4/1969 | Drone |
| 3,503,457 | A | 3/1970 | Smith et al. |
| 3,656,558 | A | 4/1972 | Kolinger |
| 3,661,215 | A | 5/1972 | Pensa |
| 3,974,881 | A | 8/1976 | Terai et al. |
| 4,013,132 | A | 3/1977 | Matsuzawa |
| 4,019,588 | A | 4/1977 | Casey |
| 4,221,267 | A | 9/1980 | Asal et al. |
| 4,306,625 | A | 12/1981 | Davis |
| 5,058,685 | A | 10/1991 | Moffitt |
| 5,477,600 | A | 12/1995 | Houle et al. |
| 5,634,523 | A | 6/1997 | Kobayashi et al. |
| 6,105,682 | A | 8/2000 | Recker et al. |
| 6,109,363 | A | 8/2000 | High |
| 6,129,155 | A | 10/2000 | Lombardi |

FOREIGN PATENT DOCUMENTS

AU 227859 * 11/1958

(Continued)

*Primary Examiner*—Victor Batson
(74) *Attorney, Agent, or Firm*—Frishauf, Holtz, Goodman & Chick, P.C.

(57) ABSTRACT

A blade mounting structure of a bulldozer capable of enhancing visibility and operability of a blade is provided. A left portion and a right portion of a blade and a vehicle main body are swingably connected with a set of left and right straight frames. The straight frames and the blade are swingably connected respectively by a hydraulic cylinder and a support member. The blade mounting structure includes an arm for connecting a single one of the straight frames and the blade to be swingable up and down and to the left and the right. A connecting point of the arm and the blade is provided on an axis line connecting horizontal axes of rotation of connecting points of the set of left and right straight frames and the blade in plane view.

14 Claims, 13 Drawing Sheets

FOREIGN PATENT DOCUMENTS

| | | | |
|---|---|---|---|
| JP | 63-136043 | U | 9/1988 |
| JP | 64-14251 | U | 1/1989 |
| JP | 5-42066 | U | 6/1993 |
| JP | 06-248663 | A | 9/1994 |
| JP | 06-248664 | A | 9/1994 |
| JP | 2546933 | Y2 | 5/1997 |
| JP | 2002-097658 | A | 4/2002 |
| SU | 543702 | * | 3/1977 |
| SU | 1481346 | * | 5/1989 |

* cited by examiner

BLADE MOUNTING STRUCTURE OF BULLDOZER

RELATED APPLICATION

This application is a continuation-in-part application of pending U.S. application Ser. No. 10/719,325 filed Nov. 20, 2003, which claims the priority of Japanese Patent Application 2003-173272 filed Jun. 18, 2003, the entire contents of both of which are incorporated herein by reference.

TECHNICAL FIELD

The present invention relates to a blade mounting structure of a bulldozer.

BACKGROUND ART

In a blade mounting structure of a bulldozer, a structure which enables the blade to incline (hereinafter, referred to as tilting) in a left and right direction as shown in, for example, FIG. 12, is conventionally known. In FIG. 12, tip end portions of a set of left and right straight frames 3 and 3 are connected to lower portions of left and right end portions of a blade 1 via connecting members JIL and JIR, which are, for example, ball joints or cross joints (joints each having a pin turning in an up-and-down direction and a pin turning in a left and right direction), to be swingable up and down and to the left and the right. Base end portions of the set of left and right straight frames 3 and 3 are respectively connected to left and right portions of a set of left and right traveling unit frames 6 at a side of a bulldozer vehicle body via ball joints J2L and J2R such that the left and right straight frames 3 and 3 are swingable up an down and to the left and the right (See FIG. 13). A hydraulic cylinder 4 for tilt drive is connected to one of side of a left or a right side of the blade 1 between upper and lower portions of the blade 1 (in FIG. 12, the hydraulic cylinder 4 is connected the right side of the blade 1 and faces the front side of the vehicle), and a support member 4*a* is connected to the other side of the blade 1, between upper and lower portions of the blade 1. The hydraulic cylinder 4 and the support member 4*a* are also respectively connected to the set of left and right straight frames 3 and 3. The hydraulic cylinder 4 and the support member 4*a* are respectively connected to the sides of the blade 1 with ball joints J4R and J4L, and to the vertical surfaces of the straight frames 3 with pin connections J5R and J5L so as to be swingable. One end portion of a link member 5 is connected to a central portion of the lower portion of the blade 1 with a pin so as to be swingable up and down. Arms 2 and 2 are connected at one end portion to the set of left and right straight frames 3 and 3 and at the other end portion to the link member 5 via ball joints J3C, J3L and J3R, respectively (for example, see page 2, and FIG. 1 and FIG. 2 of Japanese Utility Model No. 2546933).

According to another conventional mounting structure of the arms 2 and 2, two arms 2*a* and 2*a* are swingably mounted on the blade mounting structure instead of the link member 5, as shown in FIG. 13. Namely, first end portions of a set of left and right arms 2*a* and 2*a* is connected to the end portions of the set of left and right straight frames 3 and 3 on the side of the blade 1 via ball joints J6L and J6R so as to be swingable up and down and to the left and the right. The second end portions of the arms 2*a* and 2*a* are swingably connected to each other via a ball joint J7. The arms 2 and 2 are swingably connected to the second end portions of the set of left and right arms 2*a* and 2*a* via ball joints J8 and J8.

However, in the above-described conventional blade mounting structure, the following problems exist. The set of left and right arms 2 and 2, or the two sets of left and right arms 2 and 2, and 2*a* and 2*a* are mounted to a rear side of the lower portion of the blade 1. However, a predetermined clearance (corresponding to a clearance d shown in FIG. 13) is needed to avoid interference between the set of left and right arms 2 and 2 and a front portion of the vehicle main body, and therefore the blade 1 has to be located away from the vehicle body. In addition, the set of left and right arms 2 and 2, or the two sets of left and right arms 2 and 2, and 2*a* and 2*a* are connected to the blade 1. Consequently, it becomes difficult to ensure visibility of the blade 1 from a driver's seat 7 provided at the vehicle body (especially, the visibility of a left portion of the blade from the driver's seat 7 which is normally provided to be set aside on a left side of the vehicle body), and workability is therefore unfavorable at the time of a ground leveling operation and the like by the blade 1.

Furthermore, since the number of arms 2, 2, 2*a* and 2*a* (or the set of left and right arms 2 and 2) is large, the number of welding spots of the ball joints and the like which are the connecting members of the arms 2, 2, 2*a* and 2*a* (or the arms 2 and 2) is large, thus causing the entire weight of the blade to be disadvantageously increased by welding for ensuring the base material strength. In addition, the welding operation is time consuming, which increases the manufacturing cost. Still further, there are many spots, such as ball joints, to be supplied with grease such, which reduces the maintainability of the structure.

Japanese Utility Model Laid-open No. 64-14251 describes a blade mounting device having a structure for solving the above-described problems. According to Japanese Utility Model Laid-open No. 64-14251, one arm 2 is provided instead of the above-described arms 2 and 2, and the arms 2*a* and 2*a*, as shown in FIG. 14 and FIG. 15. Further, one end portion of the one arm 2 is connected to a bracket 11, which is provided at a rear surface of the blade 1, via a ball joint J3C, and the other end portion of the one arm 2 is connected to a bracket 12, which is provided at either one of the set of left and right straight frames 3 and 3 (in the example shown in the drawings, the bracket 12 is proved at the straight frame 3 at the left side, and faces the front of the vehicle) via a ball joint J3L.

However, there exist the following problems in the blade mounting device described in Japanese Utility Model Laid-open No. 64-14251. As shown in FIG. 14 and FIG. 15, the front end portions of the straight frames 3 and 3 and the rear surface of the blade 1 are connected with cross joints J10L and J10R. The cross joint J10L is constituted by a vertical pin 14L and a horizontal pin 15L which are orthogonal to each other, and the cross joint J10R is constituted by a vertical pin 14R and a horizontal pin 15R which are orthogonal to each other. The ball joint J3C, which is a connecting portion of the arm 2 at the side of the blade 1, is disposed at a position shifted to the front in a plane view of the blade mounting structure with respect to a horizontal axis line 16 in the left and right direction which connects the axes of the left and right horizontal pins 15L and 15R (as shown in FIG. 14). As a result, the line connecting the ball joint J3C and the horizontal pin 15L is not parallel to the horizontal axis line 16.

A blade mounting structure is also known which is constructed by mounting the hydraulic cylinders 4 and 4 (the one at the left side is not shown) between the left and right straight frames 3 and 3 and the blade 1, so that the blade 1 is turned with respect to the horizontal axis line 16 (hereinafter, referred to as pitch) by extending and contracting the left and the right hydraulic cylinders 4 and 4 by equal strokes. To perform pitch with such a machine, the straight frame 3 at the left side shown in FIG. 14 swings around the line connecting the ball joint J3C and the left horizontal pin 15L with respect to the blade 1, while the straight frame 3 at the right side swings around the line connecting the left and right horizontal pins 15L and 15R with respect to the blade 1. As a result, the heights of the vertical movements of the left and right end portions of the blade 1 differ. Namely, the blade 1 tilts slightly without intention following the pitch motion. Accordingly, it may be difficult to operate the blade accurately into the blade attitude desired by the operator, and operability is therefore not favorable.

The present invention is directed to overcoming one or more of the above-mentioned problems.

SUMMARY OF THE INVENTION

In accordance with one aspect of the present invention, there is provided a blade mounting structure for a bulldozer, which includes: (i) a set of left and right straight frames with which a left portion and a right portion of a blade and a vehicle are swingably connected, (ii) a hydraulic cylinder and a support member or a set of left and right hydraulic cylinders by which the set of left and right straight frames and the blade are swingably connected, and (iii) an arm for connecting a single one of the above-mentioned set of straight frames and the blade to be swingable up and down and to the left and the right. A connecting point of the arm and the blade is provided at an upper position from an axis line which connects horizontal axes of rotation of connecting points of the set of left and right straight frames and the blade in rear view.

According to the above constitution, only one of the set of left and right straight frames and the blade are swingably connected with the arm, and the load in the left and right direction exerted on the blade is supported only by the arm at the one side, whereby the attitude of the blade can be held. Further, this structure makes it possible to tilt-drive the blade following the extension of the hydraulic cylinder for tilt drive. Consequently, the link member is not needed between the blade and the arm, and the blade position becomes closer to the vehicle body by the space of the link member, thus making it possible to enhance the driving performance of the blade and to improve the weight balance of the entire bulldozer to make it possible to enhance traveling performance.

In addition, since the arm is provided at only one of the left and the right sides, visibility of the blade end portion opposite to the arm mounted side can be enhanced, and blade operability can be enhanced. Since only one arm is required, moreover, the number of welding spots of the arm connecting member is reduced, and the rigidity distribution of the blade can be concentrated on the arm mounted side. Consequently, the weight of the entire blade can be reduced, the manufacturing cost can be reduced, and the grease supplying operation for the connecting portions can be facilitated.

The connecting point of the arm and the blade may be provided at an upper position from the axis line which connects the horizontal axes of rotation of the connecting points of the set of left and right straight frames and the blade in a rear view of the blade mounting structure. According to this constitution, the left and right tilt amounts of the blade can be equalized, and therefore operability of the blade at the time of tilt can be enhanced, thus making it possible to widen the application range of this bulldozer. The arm does not interfere with the ground, rocks and stones, or the like during operation of the blade and therefore the blade operates favorably.

In accordance with another aspect of the present invention, the following blade mounting structure is provided. A connecting point of the arm and the blade is provided on an axis line which connects horizontal axes of rotation of connecting points of the set of left and right straight frames and the blade in an overhead plane view of the blade mounting structure. In addition, the connecting point of the arm and the blade may be provided on an axis line which connects horizontal axes of rotation of connecting points of the set of left and right straight frames and the blade in a rear view of the blade mounting structure. According to these constitutions, the connecting point of the arm and the blade is provided on the axis line which connects the horizontal axes of rotation of the connecting points of the set of left and right straight frames and the blade in the plane view and in the rear view, and therefore when the blade is made to perform pitch motion, tilt motion following the pitch motion does not occur, thus making it possible to enhance operability of the operator.

In these mounting structures of the blade, the connecting point of the arm and the blade may be provided at a central portion in a left and right direction of a rear surface of the blade. According to this constitution, the blade and the vehicle body can be provided to be close to each other, and therefore visibility of the blade is enhanced. The stress resulting from the load exerted on the blade acting on the straight frame via the arm can be made to be a suitable magnitude.

DETAILED DESCRIPTION OF THE INVENTION

Preferred embodiments of the present invention will be explained in detail below with reference to the drawings.

Figure 1:
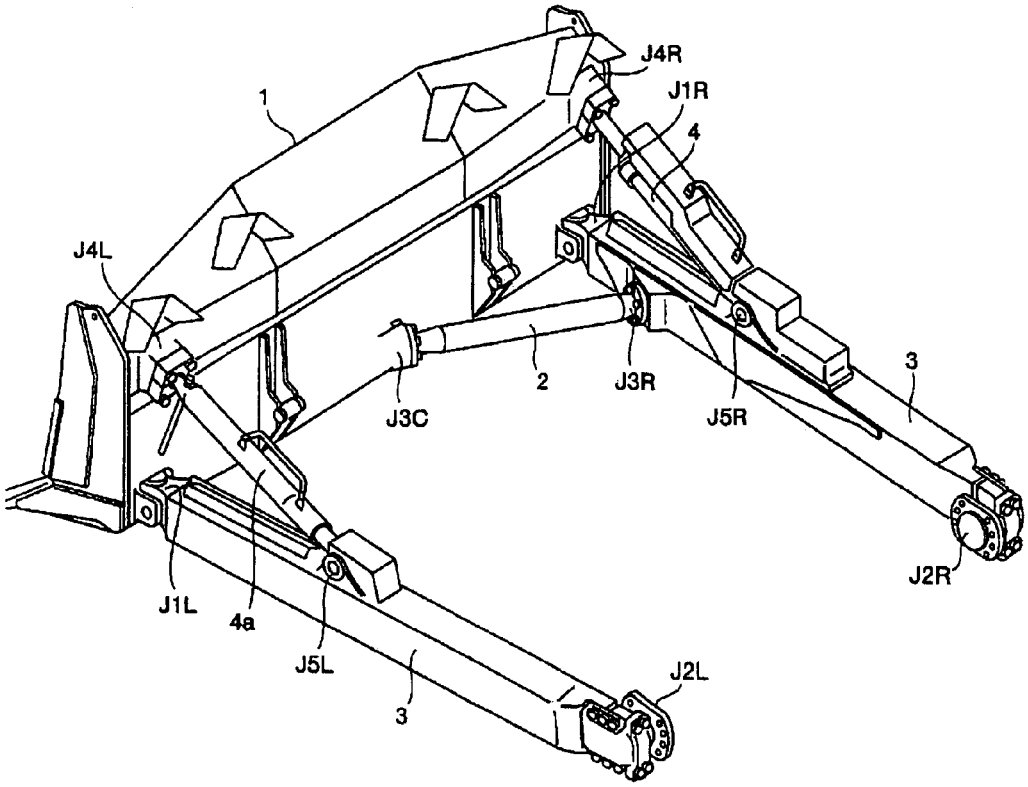
FIG. 1 is a perspective view of a mounting structure of a blade according to a first embodiment of the present invention.
Figure 12:
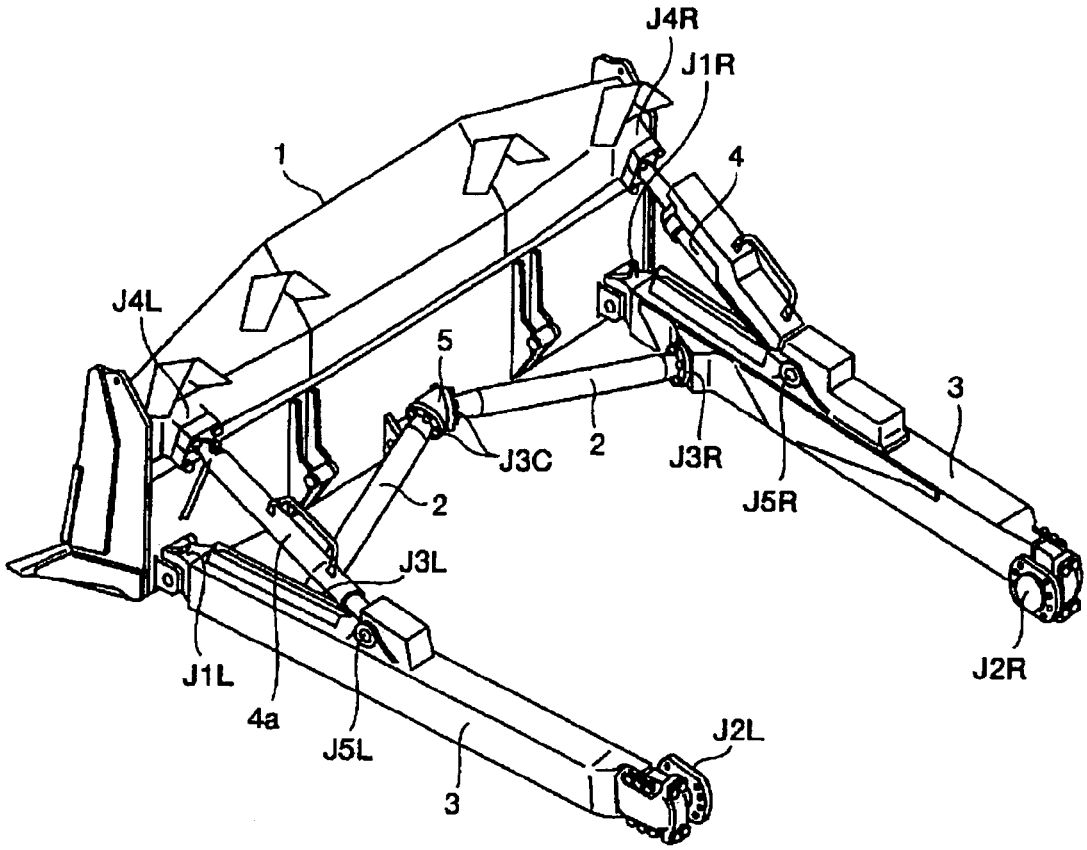
FIG. 12 Prior Art
FIG. 12 is a perspective view showing a conventional tiltable blade mounting structure.
Figure 13:
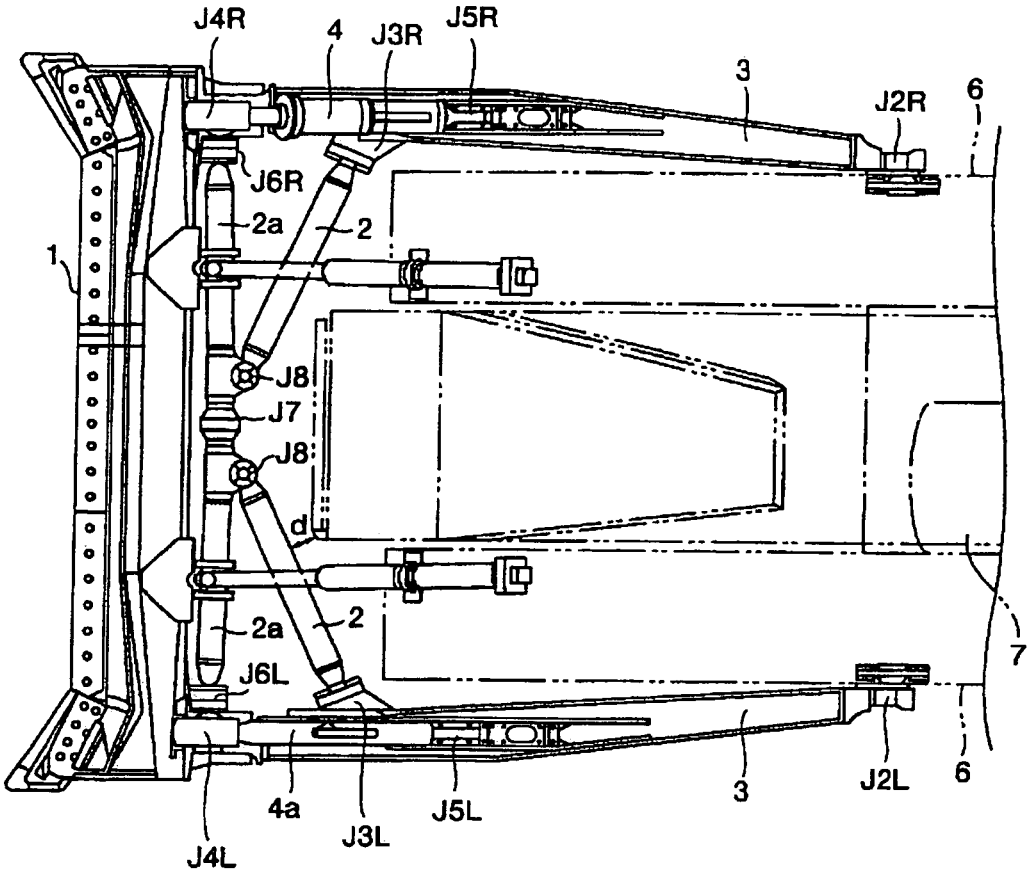
FIG. 13 Prior Art
FIG. 13 is a plane view showing another conventional tiltable blade mounting structure.
Figure 14:
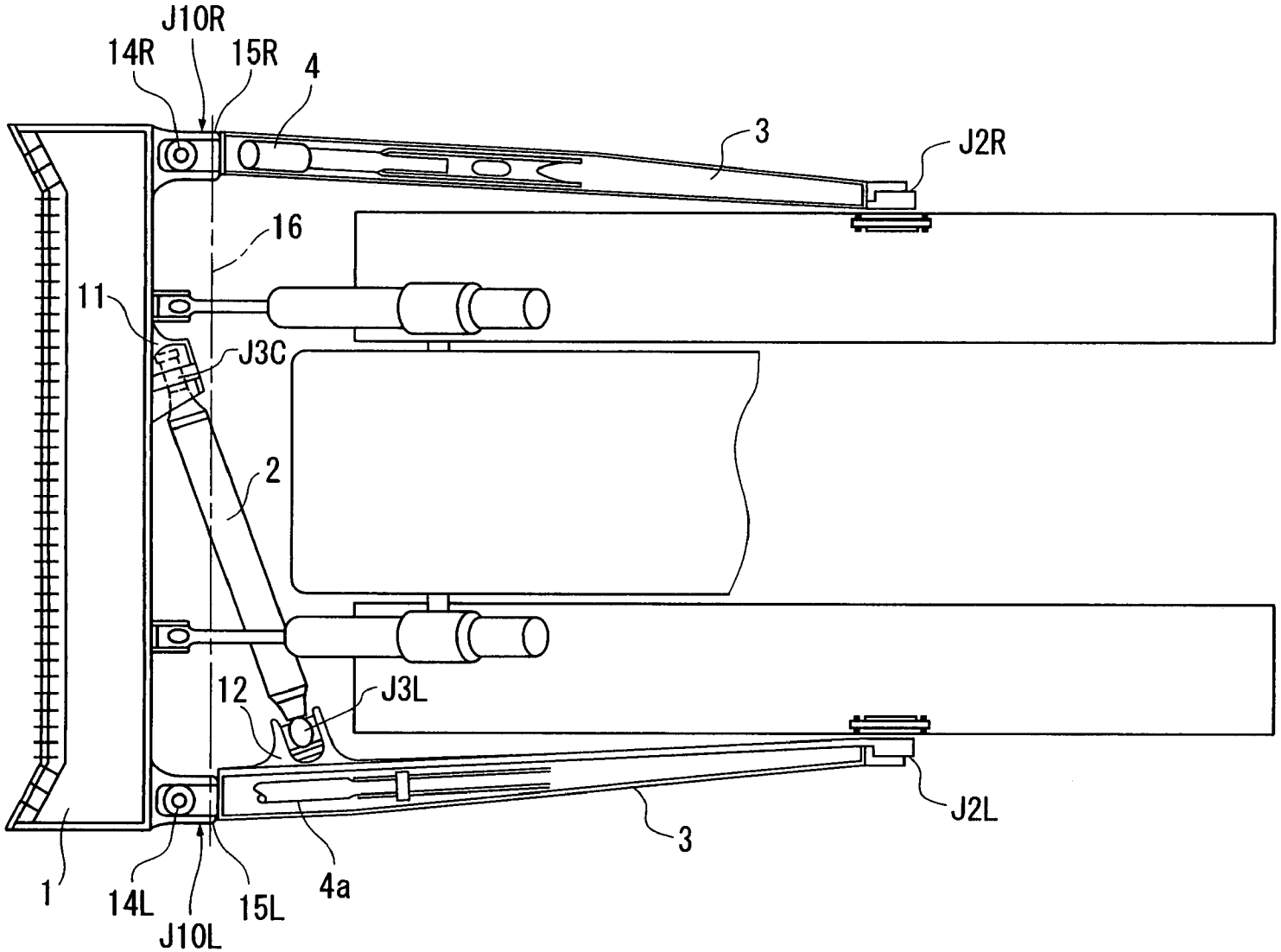
FIG. 14 Prior Art
FIG. 14 is a plane view showing another conventional blade mounting structure.
Figure 15:
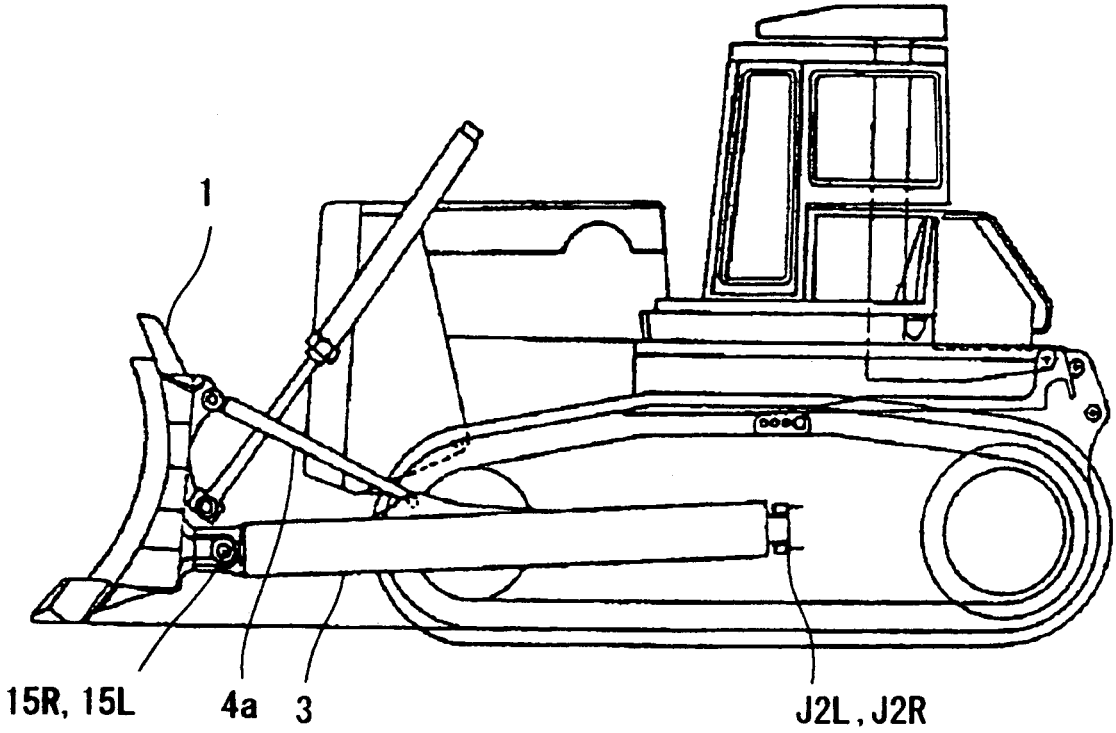
F I G. 1 5 Prior Art
FIG. 15 is a side view of the blade mounting structure shown in FIG. 14.

A first embodiment of the present invention will be initially explained based on FIG. 1 to FIG. 7. FIG. 1 is a perspective view of a mounting structure of a blade according to the first embodiment of the present invention. In the following description, components having approximately the same functions as the components shown in FIG. 12 are given the same reference numerals and symbols and the explanation thereof is omitted. Between a lower portion of an approximately center portion of the blade 1 and straight frames 3 and 3, one arm 2 is connected to only one of a left or a right straight frame 3 via ball joints J3C and J3R. When a driver's seat 7 (see FIG. 13) is provided on the left side of a vehicle body, it is preferable to provide the one arm 2 at the right side of the blade 1 to enhance visibility from the driver's seat 7. Rigidity of the blade 1 against an external force in a left and right direction is ensured by the one arm 2. The ball joint J3R may be a pin joint.

Figure 2:
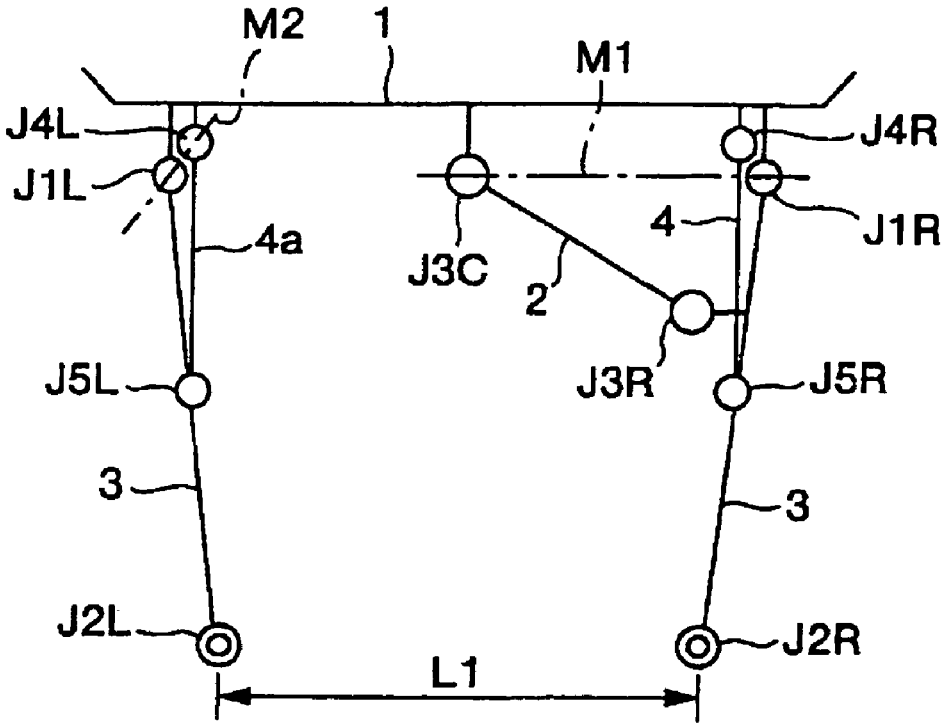
FIG. 2 is a skeleton plane diagram for explaining an operation of the first embodiment of the present invention.
Figure 3:
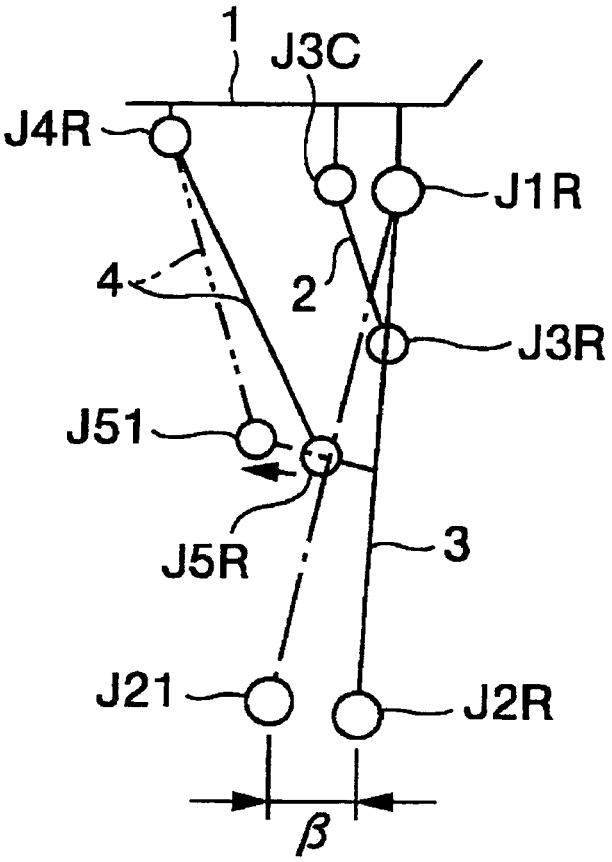
FIG. 3 is a skeleton right side diagram for explaining the operation of the first embodiment of the present invention.
Figure 4:
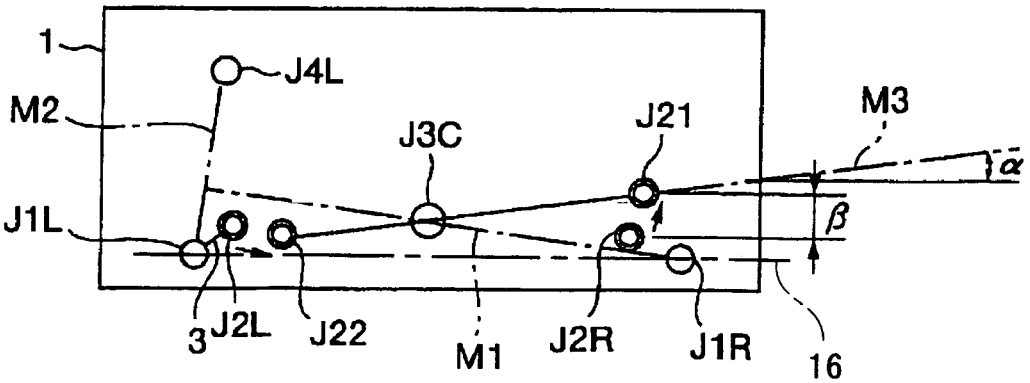
FIG. 4 is a skeleton diagram for explaining the operation of the first embodiment of the present invention, and is a diagram of the blade seen from a rear.

Next, based on FIG. 2 to FIG. 4, an operation of the blade 1 with the above-described constitution will be explained. FIG. 2 to FIG. 4 are skeleton diagrams for explaining the operation; FIG. 2 is a plan diagram; FIG. 3 is a right side of FIG. 2; and FIG. 4 is a front diagram of FIG. 2 (diagram of the blade 1 seen from the rear). Here, for explanation, a connecting portion such as a ball joint or a cross joint is called a connecting point.

A case in which a tilt driving hydraulic cylinder 4 is contracted will be explained. The case is considered with the attitude of the blade 1 being fixed in a vertical state shown in FIGS. 2 and 3. When the tilt driving hydraulic cylinder 4 is contracted, as shown by the two-dot chain line in FIG. 3, a connecting point J5R of the hydraulic cylinder 4 and the right straight frame 3 moves to an upper position J51. Following this, a connecting point J2R of the right straight frame 3 with a vehicle main body is moved to J21 which is away from the starting position of J2R upward by a height β. As a result, the right straight frame 3 is rotated around a line Ml that connects connecting points J1R and J3C as a center of rotation. In this situation, under the limiting condition that length of each link (which is a general term for the blade 1, the straight frame 3, the arm 2, a support member 4*a* and the like), and a length L1 between a connecting point J2L and the connecting point J2R of a set of left and right straight frames 3 and 3 and the vehicle main body are fixed, each link is moved. Consequently, as shown in FIG. 4, the left straight frame 3 to which the support member 4*a* is connected is rotated around a line M2 that connects connecting points J1L and J4L as a center of rotation, and the connecting point J2L of the left straight frame 3 and the vehicle main body is moved to J22. As a result, when the attitude of the blade 1 is looked at again with a line M3 that connects the connecting points J21 and J22 of the straight frames 3 and 3 with the vehicle main body as the reference (namely, with the vehicle main body fixed in a horizontal state), the blade 1 is tilted by a predetermined angle α with a right side facing down. Namely, by contracting the tilt driving hydraulic cylinder 4, the blade 1 is tilted so that the right side faces down.

A position of the connecting point J3C of the one arm 2 on the blade side is located at an upper position from a line 16 that connects the connecting points J1L and J1R of the set of left and right straight frames 3 and 3 on the blade side in the rear view (see FIG. 4), and therefore the tilt amounts on the left and right become equal with the horizontal state of the blade 1 as the reference.

Figure 5:
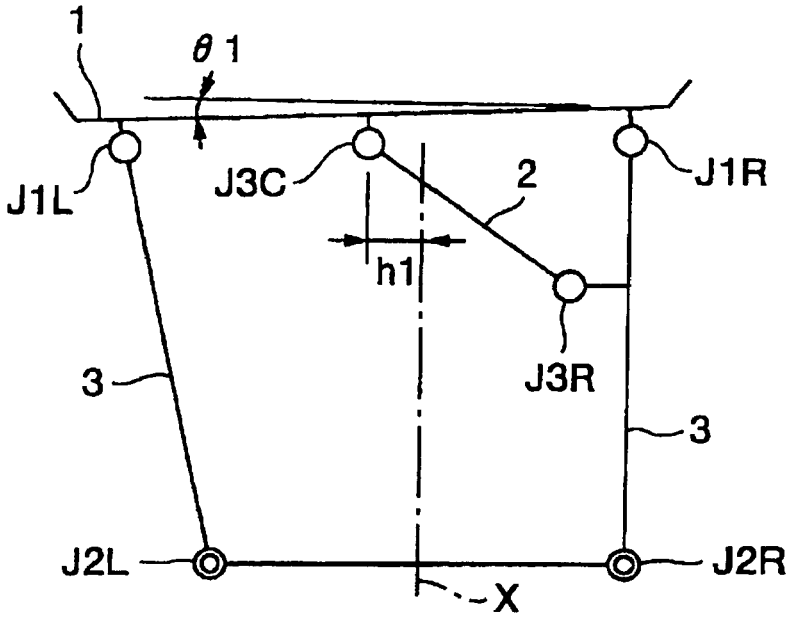
FIG. 5 is a skeleton diagram for explaining the operation of the first embodiment of the present invention, and shows an off-set state of the blade to a left side.
Figure 6:
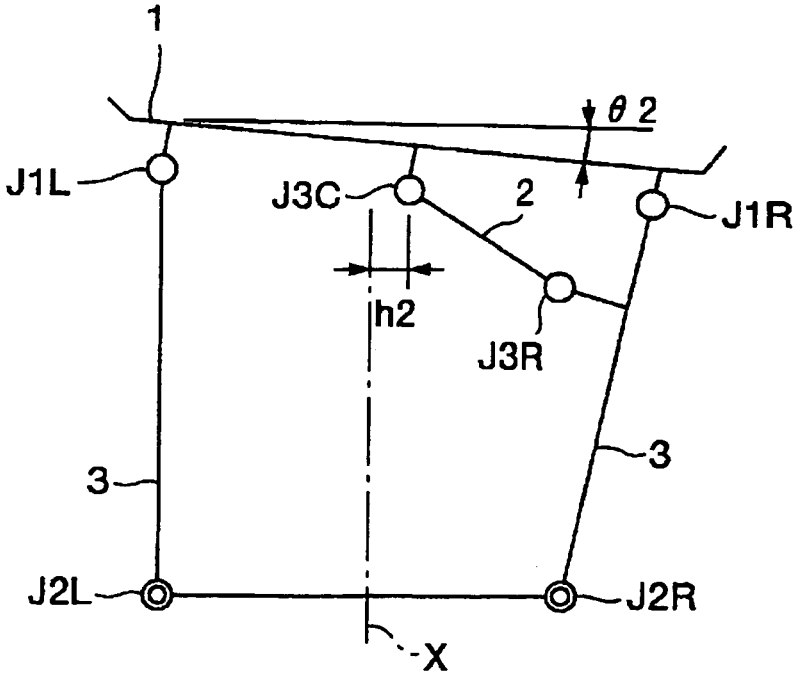
FIG. 6 is a skeleton diagram for explaining an operation of the first embodiment of the present invention, and shows an off-set state of the blade to a right side.

In the above-described constitution, a little angular motion (motion of changing the angle of the blade 1 with respect to the vehicle body center line) is performed with the tilt motion. Namely, when the tilt driving hydraulic cylinder 4 is contracted, the connecting point J3C is off-set to the left side from a center line of the vehicle main body between the connecting points J21 and J22 of the set of left and right straight frames 3 and 3 and the vehicle main body, as understood from FIG. 4. FIG. 5 shows this state. As the connecting point J3C is off-set to the left side by h1 with respect to a vehicle body center line X in a longitudinal direction, the blade 1 is inclined (the angular operation) correspondingly by a predetermined angle θ1 to be in an attitude with a left end portion of the blade 1 being displaced rearward with respect to a right end portion of the blade 1 in the plane view. On the other hand, when the tilt driving hydraulic cylinder 4 is extended, the connecting point J3C is off-set to the right side by h2 with respect to the vehicle body center line X, and the blade 1 performs the angular motion by a predetermined angle θ2 to be in an attitude with the right end portion of the blade 1 being moved rearward with respect to the left end portion of the blade 1 in the plane view, as shown in FIG. 6.

Figure 7:
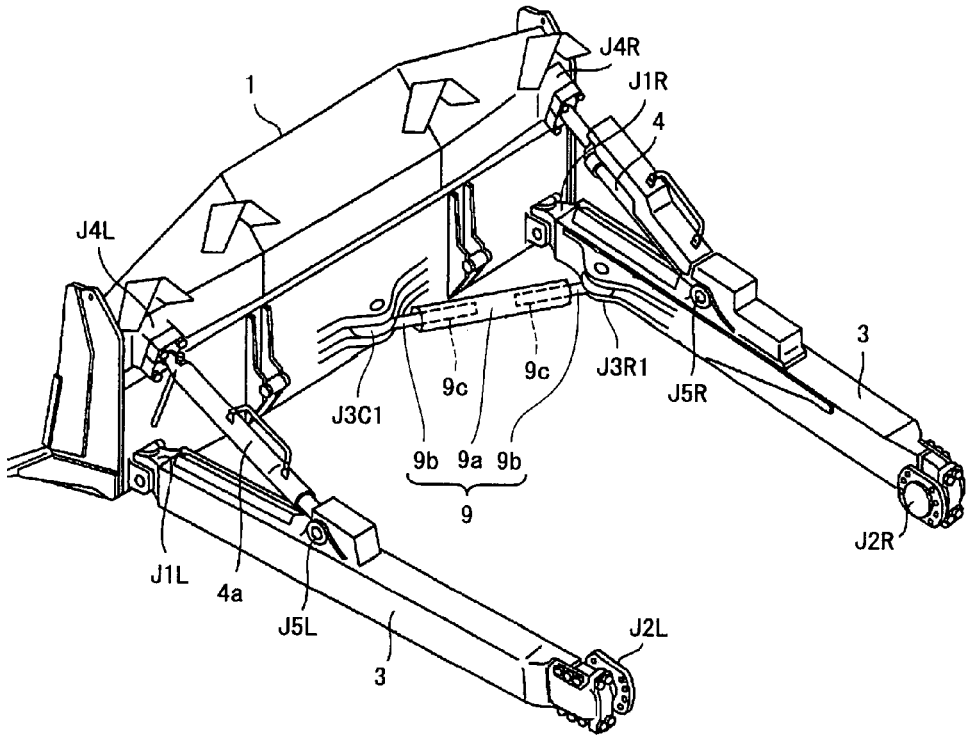
FIG. 7 is an explanatory view of another arm constitution according to the first embodiment of the present invention.

In the above-described embodiment, the length of the one arm 2 is fixed, but this is not required. For example, the length of the arm 2 may be constituted to be variable, whereby the angling angle θ can be changed, and the bulldozer can be used as an angledozer. In this case, the arm 2 may be constituted by, for example, an extendable and contractible actuator such as a hydraulic cylinder (for example, the hydraulic cylinder 4 in FIG. 1). Further, the arm 2 may be replaced with an arm 9 which is constituted by connecting members 9*b*, 9*a* and 9*b* of which length is made variable by changing fastening positions by screws 9*c* and 9*c*, as shown in FIG. 7. In the arm 9, the connecting member 9*b* at the left side is connected to the blade 1 via a universal joint (for example, a ball joint or the like) J3G1, and the connecting member 9*b* at the right side is connected to the straight frame 3 via a pin joint J3R1. The pin joint J3R1 may be a ball joint. The length of the arm 2 shown in FIG. 5 is set to be longer than the length of the arm 2 shown in FIG. 6, and the longer the length of the arm 2, the smaller the angling angle θ with respect to the same tilt amount (tilt angle α.

According to this embodiment, the following effect is provided. The one arm 2 for connecting the central lower portion of the blade 1 and the straight frame 3 is provided at only one of the left and the right straight frames 3 and 3, and the rigidity (namely, the attitude) of the blade 1 against the external force from the left and right direction is held by the arm 2. In this situation, the arm 2 is connected to the blade 1 via the connecting member such as the ball joint J3C without the link member 5 which is conventionally used. Since this makes the position of the blade 1 nearer to the vehicle main body by the length of the link member 5 as compared with the prior art, a pressing force of the blade 1 is exhibited efficiently to make it possible to enhance the working performance, and the weight balance of the entire vehicle is improved to make it possible to enhance the traveling performance.

Further, since the blade 1 is located closer to the vehicle body, visibility can be enhanced. That is, since the arm 2 can be located closer to the blade 1 by the length of the link member 5 which is eliminated, visibility of the blade 1 can be easily ensured. Since the arm does not exist at the end portion of the blade 1 at the opposite side from the mounting side of the one arm 2, visibility of the blade 1 can be more enhanced. Especially by providing the arm 2 at the side far from the driver's seat provided at the side of the vehicle body, the visibility of the blade end portion at the side near thereto can be enhanced. As a result, blade operability during a ground leveling operation can be enhanced. Further, since the number of the connected arms 2 is only one, the welding spots of the connecting portions are decreased, thus making it possible to reduce manufacturing cost and reduce the entire weight including the blade peripheral components. Further, the number of grease supplying spots at the connecting portion is small, and therefore the grease supplying operation can be easily performed.

The arm 2 is connected on only one of the left or the right side, whereby the rigidity distribution of the mounting structure of the blade 1 can be concentrated on the mounting side of the arm 2. Consequently, the base material strength distribution for welding can be concentrated on one side, and therefore reduction in the entire weight including the blade peripheral components can be achieved. Further, the load of the arm 2 for supporting lateral load does not act on the straight frame 3 to which the arm 2 is not connected, and therefore the reduction of the weight of the straight frame 3 and simplification of the structure thereof can be achieved.

The connecting point J3C of the one arm 2 to the blade 1 is provided at the upper position from the line connecting the connecting points J1L and J1R of the set of left and right straight frames 3 and 3 and the blade 1. Further, the axis of rotation of the straight frame 3 at the right side, namely, the line M1 that connects the connecting points J1R and J3C is made to intersect the axis of rotation of the straight frame 3 at the left side, namely, the line M2, which connects the connecting points J1L and J4L, at approximately 90 degrees, whereby the left and right tilt amounts can be equalized. This makes it possible to enhance the tilt operability and widen the application range of this bulldozer.

The one arm 2 may be constituted to be variable in length with the hydraulic cylinder or the like, whereby the angling angle of the blade 1 can be changed, thus making it possible to use the bulldozer as an angledozer. Further, if the length of the arm 2 is constituted to be variable, it is also possible to off-set the blade 1 in the left and right direction. As a result, mole-plowing, and earth discharging operations to a valley at an edge of a precipice can be facilitated, and the application range of the bulldozer can be increased.

In the first embodiment, the explanation is made with the constitution example of a so-called single tilt, in which the tilt driving hydraulic cylinder 4 is provided at only one of the left or right side, but the present invention is not limited to this constitution, and the present invention may adopt the constitution provided with the hydraulic cylinders 4 at both left and right sides, as explained below.

Figure 8:
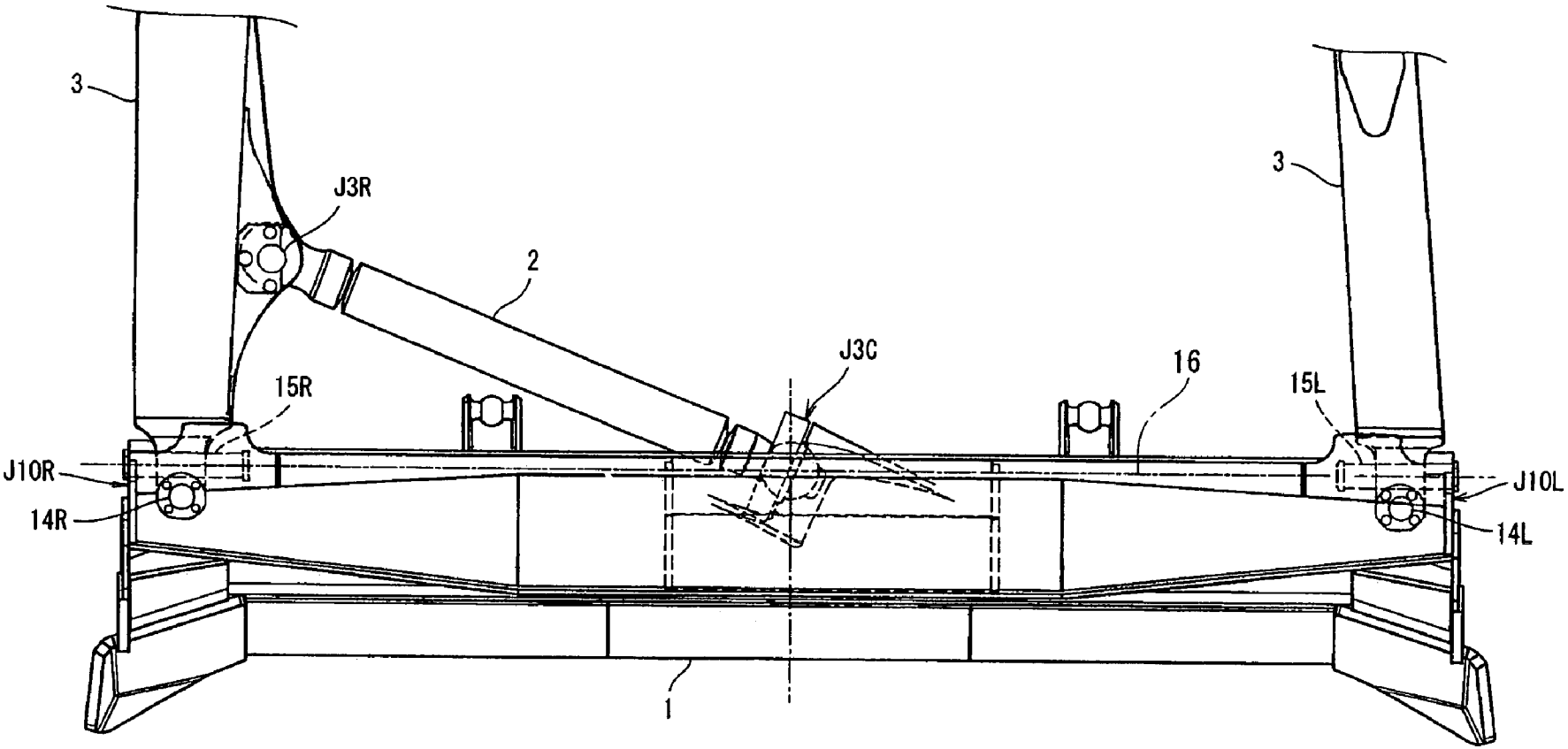
FIG. 8 is a plane view explaining a blade mounting structure according to a second embodiment of the present invention.
Figure 9:
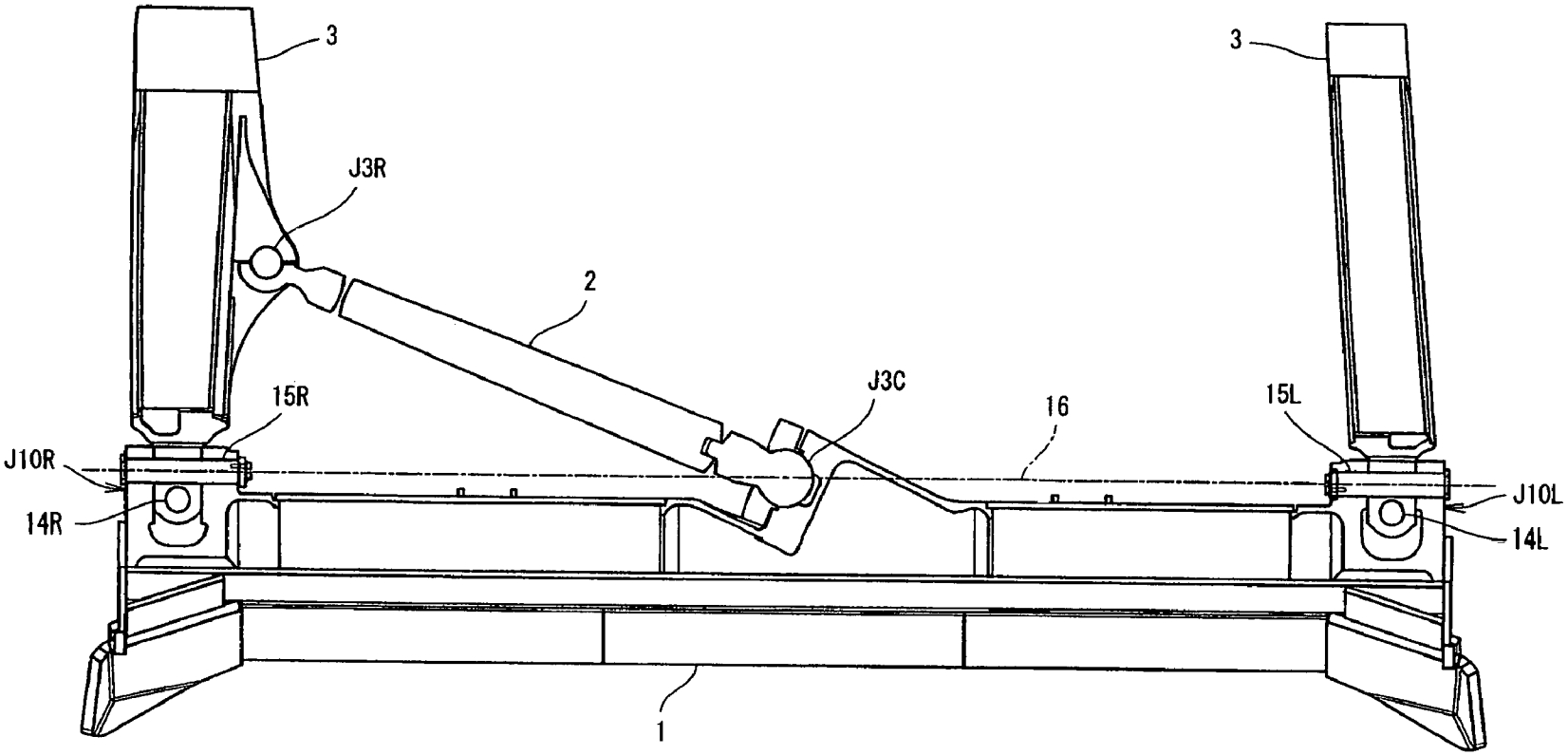
FIG. 9 is an explanatory view of a section in plan view passing through a center of a ball joint J3C in FIG. 8.
Figure 10:
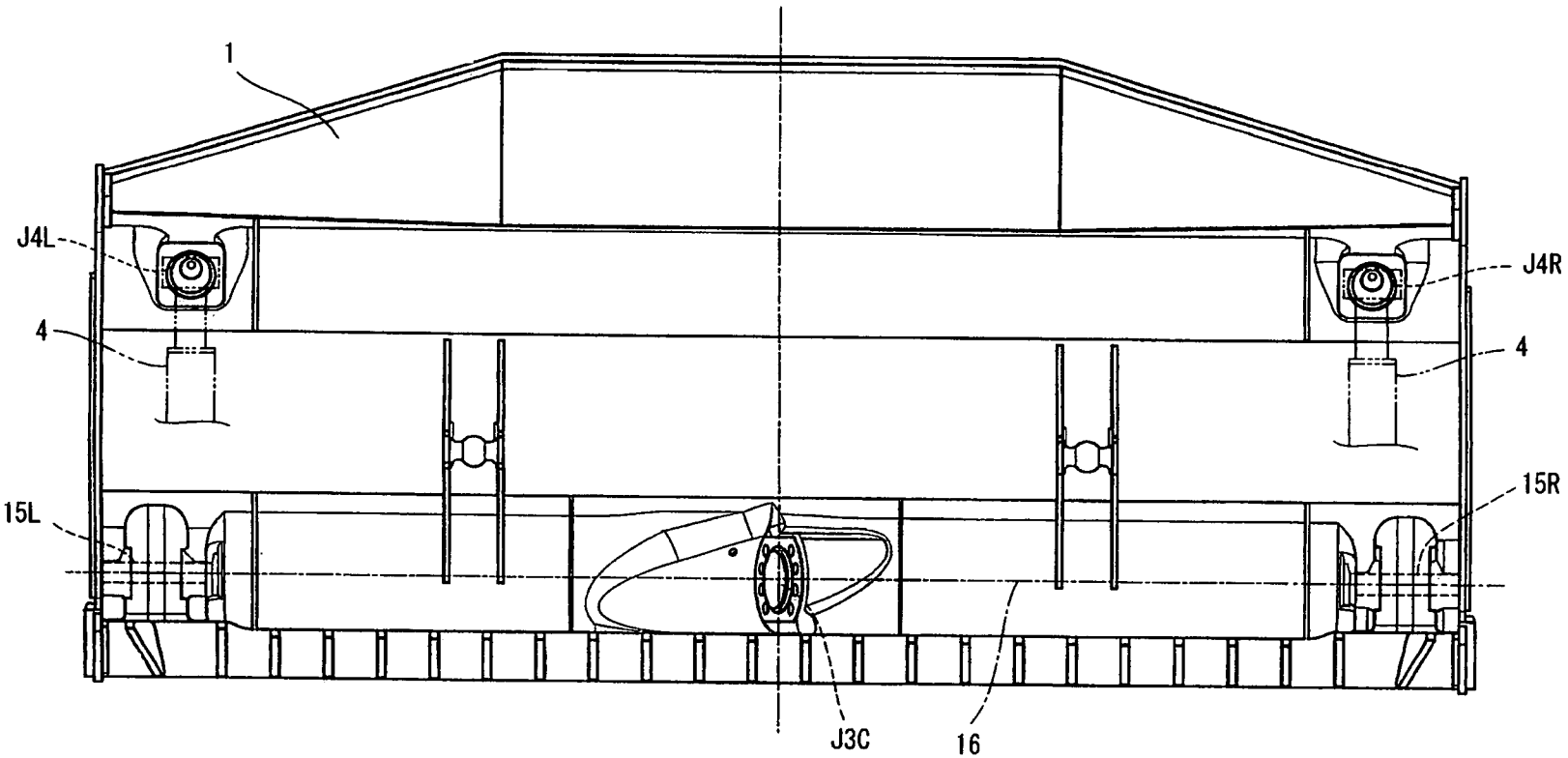
FIG. 10 is a rear view of a blade single body for explaining a blade mounting structure according to the second embodiment of the present invention.

Next, a second embodiment will be explained based on FIG. 8 to FIG. 10. In this embodiment, a set of left and right straight frames 3 and 3 are connected to a rear surface of a blade 1 via cross joints J10L and J10R having vertical pins 14L and 14R and horizontal pins 15L and 15R. A ball joint J3C which is a connecting portion of an arm 2 and the blade 1 is disposed on the horizontal axis line 16 connecting axes of the horizontal pins 15L and 15R of the above-described cross joints J10L and J10R in the plane view as shown in FIG. 9. The ball joint J3C is disposed on the horizontal axis 16 in the rear view as shown in FIG. 10. A set of left and right hydraulic cylinders 4 and 4 for tilt and pitch drive are respectively mounted between left and right upper portions of the rear surface of the blade 1 and the set of left and right straight frames 3 and 3. The other constitution is the same as in the first embodiment, and the explanation thereof will be omitted.

According to another embodiment, the following operational effect is provided. The horizontal axis line 16 which connects the axes of the horizontal pins 15L and 15R of the cross joints J10L and J10R corresponds to a line which connects either one of the horizontal pins 15L or 15R and the ball joint J3C (namely, both the lines are parallel in the plane view and the side view). Therefore, when the blade 1 is made to perform pitch motion, the blade 1 performs pitch swing around only the horizontal axis line 16 as the center of rotation. Namely, only the pitch motion is performed, and a tilt motion does not occur following this. Accordingly, the operator can operates the blade 1 to be in a desired attitude with high precision by the pitch operation or the tilt operation, and therefore the operability is enhanced dramatically.

Figure 11:
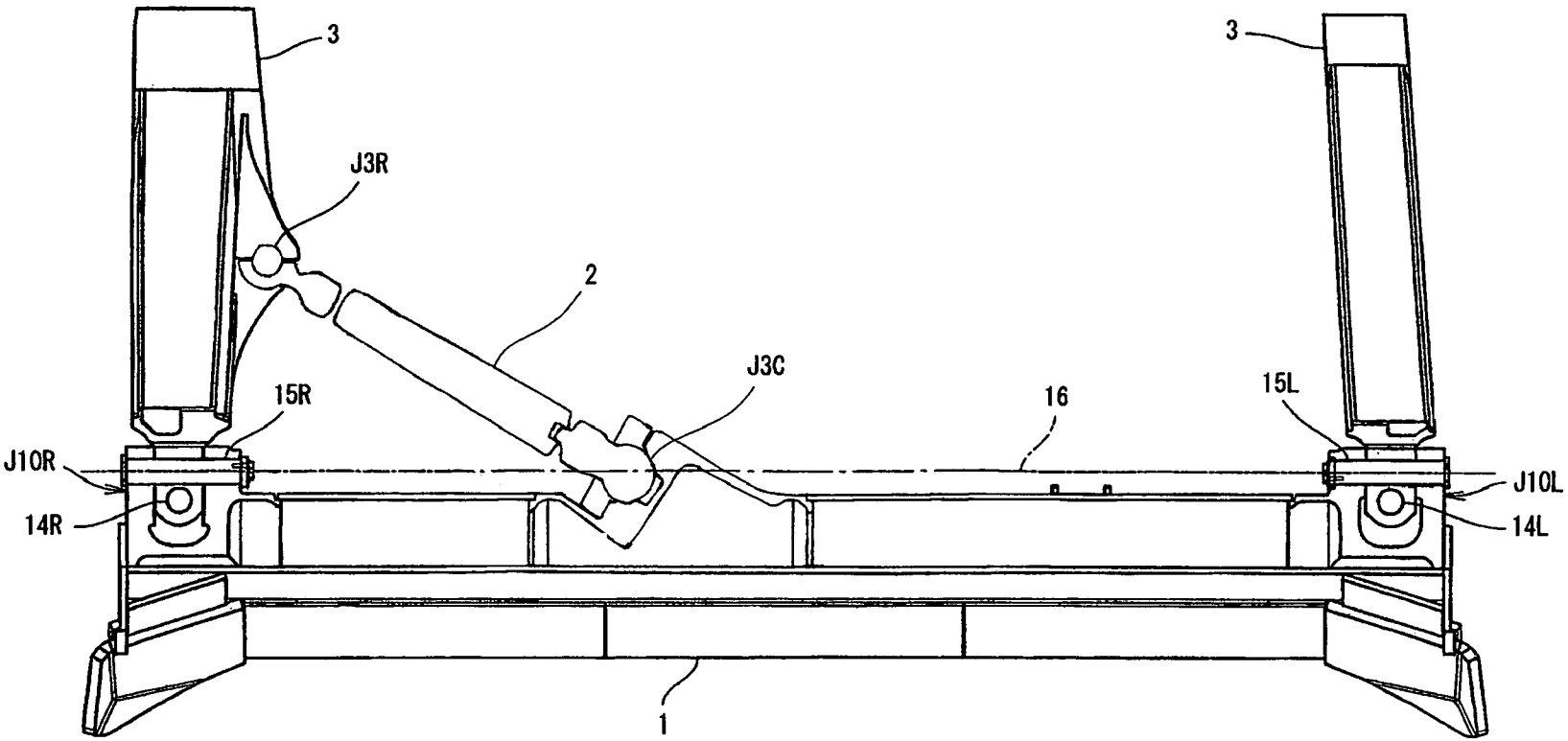
FIG. 11 is an explanatory view of another arm constitution according to the present invention.

In the above-described second embodiment, the example in which the ball joint J3C is provided at the central portion in the left and right direction of the blade 1 is shown, but the present invention is not limited to this, and the ball joint J3C may be provided at the position deviated from the central portion in the left and right direction as shown in FIG. 11, for example. In this situation, a tilt motion does not occur at the time of pitch motion as a result of providing the ball joint J3C on the horizontal axis line 16 in the plane view and in the rear view as described above.

What has been described herein is merely illustrative of the present invention. Other aspects and features obtained from a study of the drawings, the disclosure, and the appended claims are also within the scope and spirit of the invention.

What is claimed is:

1. A blade mounting structure of a bulldozer, comprising:

a set of left and right straight frames which swingably connect a left portion and a right portion of a blade to a left portion and a right portion of a vehicle main body, wherein only a single one of the left and right straight frames has an additional connection to the blade; and a single arm to provide said additional connection between said single one of the set of left and right straight frames and the blade;

wherein said single arm is swingable up and down and to a left direction and a right direction; and wherein a connecting point of the arm and the blade is provided at an upper position with respect to an axis line which connects horizontal axes of rotation of connecting points of the set of left and right straight frames and the blade in a rear view of the blade mounting structure; and wherein the connecting point of the arm and the blade is provided on the axis line which connects the horizontal axes of rotation of the connecting points of the set of left and right straight frames and the blade in an overhead plane view of the blade mounting structure.

2. The blade mounting structure of the bulldozer according to claim 1, wherein a hydraulic cylinder and a support member swingably connect the set of left and right straight frames to the blade.

3. The blade mounting structure of the bulldozer according to claim 1, wherein a set of left and right hydraulic cylinders swingably connect the set of left and right straight frames to the blade.

4. The blade mounting structure of the bulldozer according to claim 1, wherein the connecting point of the arm and the blade is provided at a central portion in a left and right direction of a rear surface of the blade.

5. A blade mounting structure of a bulldozer, comprising:

a set of left and right straight frames which swingably connect a left portion and a right portion of a blade to a left portion and a right portion of a vehicle main body, wherein only a single one of the left and right straight frames has an additional connection to the blade; and a single arm to provide said additional connection between said single one of the set of left and right straight frames and the blade;

wherein said single arm is swingable up and down and to a left direction and a right direction; and wherein a connecting point of the arm and the blade is provided on an axis line which connects horizontal axes of rotation of connecting points of the set of left and right straight frames and the blade in an overhead plane view of the blade mounting structure.

6. The blade mounting structure of the bulldozer according to claim 5, wherein a hydraulic cylinder and a support member swingably connect the set of left and right straight frames to the blade.

7. The blade mounting structure of the bulldozer according to claim 5, wherein a set of left and right hydraulic cylinders swingably connect the set of left and right straight frames to the blade.

8. The blade mounting structure of the bulldozer according to claim 5, wherein the connecting point of the arm and the blade is provided at a central portion in a left and right direction of a rear surface of the blade.

9. The blade mounting structure of the bulldozer according to claim 5, wherein the connecting point of the arm and the blade is provided on the axis line which connects the horizontal axes of rotation of the connecting points of the set of left and right straight frames and the blade in a rear view of the blade mounting structure.

10. The blade mounting structure of the bulldozer according to claim 5, wherein the connecting point of the arm and the blade is provided at a central portion in a left and right direction of a rear surface of the blade.

11. A blade mounting structure of a bulldozer, comprising:

a set of left and right straight frames which swingably connect a left portion and a right portion of a blade to a left portion and a right portion of a vehicle main body, wherein only a single one of the left and right straight frames has an additional connection to the blade; and a single arm to provide said additional connection between said single one of the set of left and right straight frames and the blade;

wherein said single arm is swingable up and down and to a left direction and a right direction; and wherein a connecting point of the arm and the blade is provided on an axis line which connects horizontal axes of rotation of connecting points of the set of left and right straight frames and the blade in a rear view of the blade mounting structure.

12. The blade mounting structure of the bulldozer according to claim 11, wherein a hydraulic cylinder and a support member swingably connect the set of left and right straight frames to the blade.

13. The blade mounting structure of the bulldozer according to claim 11, wherein a set of left and right hydraulic cylinders swingably connect the set of left and right straight frames to the blade.

14. The blade mounting structure of the bulldozer according to claim 11, wherein the connecting point of the arm and the blade is provided at a central portion in a left and right direction of a rear surface of the blade.

* * * * *